United States Patent [19]

Fischer

[11] 4,408,940

[45] Oct. 11, 1983

[54] BOLT ANCHOR ASSEMBLY

[76] Inventor: Mark L. Fischer, P.O. Box 627, Merton, Wis. 53056

[21] Appl. No.: 300,011

[22] Filed: Sep. 8, 1981

[51] Int. Cl.[3] ..... F16B 39/22

[52] U.S. Cl. ..... 411/258; 411/107; 411/401; 52/295; 248/679

[58] Field of Search ..... 411/107, 103, 82, 401, 411/402, 38; 285/56, 64; 248/679, 680; 52/295, 296

[56] References Cited

U.S. PATENT DOCUMENTS

| | | | |
|---|---|---|---|
| 2,765,135 | 10/1956 | Chellis | 52/295 X |
| 3,401,733 | 9/1968 | Circle | 411/107 |
| 3,597,893 | 1/1971 | Spanel | 248/679 X |
| 4,029,275 | 6/1977 | Erismann | 248/680 |
| 4,293,259 | 10/1981 | Liebig | 411/38 X |

*Primary Examiner*—Wayne L. Shedd

*Attorney, Agent, or Firm*—Ronald E. Barry

[57] ABSTRACT

A bolt anchor assembly including an anchor member to be imbedded in concrete, the anchor member having a hollow tubular portion and a base plate, the base plate projecting outwardly from the tubular portion, and a bolt projecting axially through the base plate and tubular portions for attachment to the base of a piece of machinery.

5 Claims, 3 Drawing Figures

BOLT ANCHOR ASSEMBLY

BACKGROUND OF THE INVENTION

Anchor bolts are commonly used to secure various types of machines and structures to concrete surfaces. The anchor bolts are commonly placed in position and the concrete poured so that the anchor bolt becomes imbedded in the concrete with a portion of the bolt extending above the surface of the concrete. The anchor bolt commonly has an enlarged head which is imbedded in the concrete at a depth considered sufficient to provide the strength required to hold the machine or structure in position. Once the anchor bolt has been located in the concrete it is rigid and difficult to adjust to accommodate variations in location. Also because of the rigid mounting of the bolt in the concrete, overstressing of the bolt can occur, sometimes resulting in breaking or weakening of the bolt.

SUMMARY OF THE INVENTION

The anchor bolt assembly according to the present invention is imbedded in concrete but allows for lateral movement of the bolt to accommodate out-of-center location of mounting holes in the machinery. The assembly includes a hollow tubular member having a base plate mounted on one end with a central opening to accommodate standard bolts, threaded rods, rod couplers, nuts, and washers. The hollow tubular member in conjunction with the base plate can be designed to provide predictable strengths of the bolt without concrete failure.

IN THE FIGURES

DETAILED DESCRIPTION OF THE INVENTION

Figure 1:
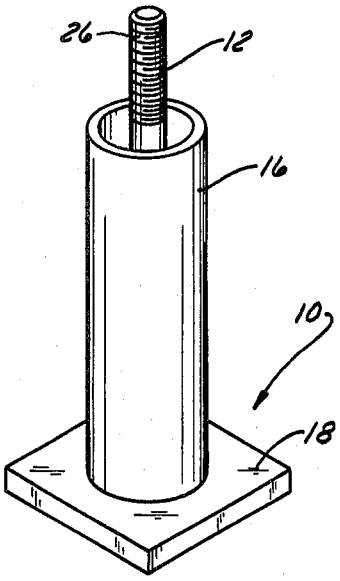
FIG. 1 is a perspective view of the anchor bolt assembly according to the invention.

The anchor bolt assembly as seen in the drawings generally includes an anchor member 10 and a bolt 12. The anchor member is imbedded in concrete 14 with the upper edge of the anchor member at the same level as the top surface of the concrete. The stresses introduced into the bolt 12 when used to anchor a machine to the surface of the concrete are initially imparted to the anchor member and through the anchor member to the concrete.

Figure 2:
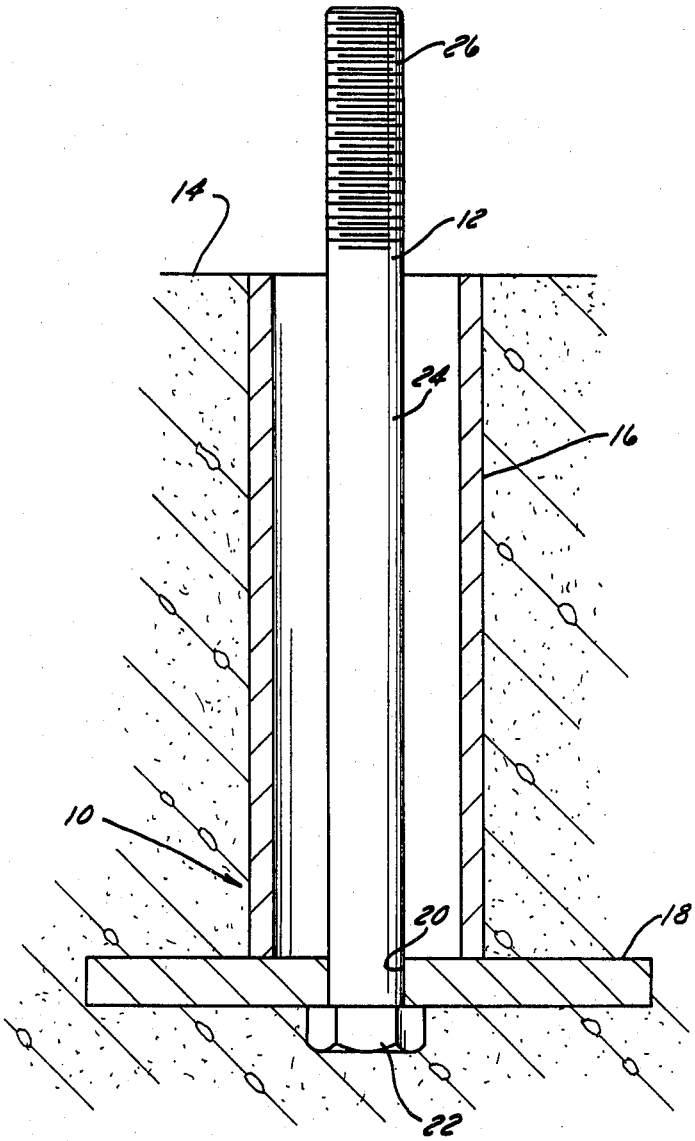
FIG. 2 is a section view in elevation showing the anchor bolt assembly imbedded in concrete.

In this regard and referring to FIG. 2 the anchor member 10 generally includes a hollow tubular portion 16 in the form of a pipe and a base plate 18 of rectangular, as seen in the drawing, circular or other design configuration. The base plate 18 is secured to the bottom of the tubular portion 16 and includes a central opening 20 which is coaxial with the axis of the tubular portion 16. The base plate 18, as shown, is in the form of a square and extends outwardly from the bottom of the tubular portion 16 a distance sufficient to be imbedded in the concrete 14.

The bolt 12 includes a head and a shank 24 having a threaded section 26 at the upper or outer end of the bolt. The bolt is inserted through the opening 20 prior to imbedding the anchor member in the concrete with the head in abutting relation to the outside surface of the plate 18. The head 22 is generally of hexagonal configuration but can be square or any other irregular configuration which when imbedded in the concrete will prevent rotation of the bolt 12.

Figure 3:
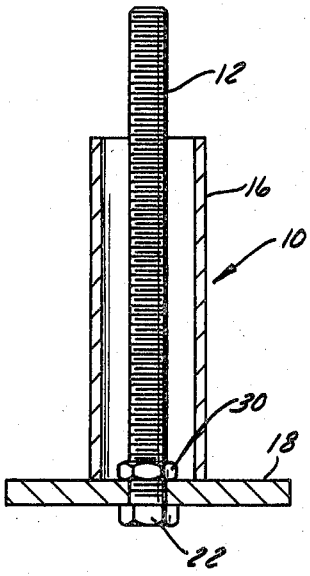
FIG. 3 is a section view in elevation showing a load supporting anchor bolt assembly.

In the event the bolt anchor assembly is used as a load support, a nut 30, as seen in FIG. 3, is provided on the bolt 12 above the plate 18. Any load on the bolt 12 will then be applied to the plate 18 by means of the nut 30. This arrangement makes it possible to use the assembly as a machine support.

The tubular portion 16 allows for a certain amount of movement of the bolt 12 within the tubular portion to accommodate any out-of-center condition when mounting equipment thereon. The base plate, although made out of steel, will allow for a certain amount of flexibility when tightening the bolts onto the equipment due to the bending of the central portion of the plate within the confines of the tubular portion 16.

It is generally desired to provide sufficient depth of concrete, so that the strength of the concrete exceeds the strength of the bolt. The advantage of the present anchor member is that this depth can be readily determined from the size of the bolt. This ratio is approximately one to nine. A one inch bolt requiring nine inches of concrete.

I claim:

1. A bolt anchor assembly comprising an anchor member adapted to be imbedded in concrete and a bolt positioned within said anchor member and extending beyond the end of the anchor member for attaching a machine to a concrete surface, said anchor member including a hollow tubular portion and a base plate secured to the bottom of said tubular portion, said hollow tubular portion having inside diameter greater than the diameter of said bolt, said base plate having a central opening and extending outwardly beyond the outside perimeter of the tubular portion, and said bolt having a head at one end and a threaded section at the other end, said bolt being positioned in said opening with the head of said bolt bearing on the bottom of said base plate, whereby said base plate and the head of said bolt will become imbedded in the concrete.

2. The assembly according to claim 1 wherein the length of the tubular portion of the anchor member is approximately nine times the diameter of the bolt.

3. A bolt anchor assembly comprising an anchor member adapted to be imbedded in concrete and a bolt member secured to said anchor member for attaching a machine to the concrete, said anchor member including a hollow tubular portion having an inside diameter greater than the outside diameter of said bolt member to allow a limited amount of movement for said bolt member, said anchor member includes a plate having a central opening and extends outwardly from the perimeter of said tubular member and said bolt member including a bolt positioned in said opening and having a head attaching said bolt member to the bottom of said plate.

4. The assembly according to claim 3 wherein said bolt is threaded throughout the full length of the bolt, and including a nut on said bolt on the inside of said anchor member supporting a compressive load on said base plate.

5. The bolt anchor assembly according to claim 3 including a plate on the bottom of said first member having a flange projecting outwardly from said tubular portion.

* * * * *